US005380156A

United States Patent [19]

Iacovino

[11] Patent Number: 5,380,156

[45] Date of Patent: Jan. 10, 1995

[54] CEILING FAN BALANCE APPARATUS

[76] Inventor: Robert Iacovino, 8404 8th St., Converse, Tex. 78109-2611

[21] Appl. No.: 44,756

[22] Filed: Apr. 12, 1993

[51] Int. Cl.[6] ..... F04D 29/66

[52] U.S. Cl. ..... 416/5; 416/144

[58] Field of Search ..... 416/144, 146 R, 5; 248/231.8, 229; 24/336, 339

[56] References Cited

U.S. PATENT DOCUMENTS

| | | | |
|---|---|---|---|
| 1,141,337 | 6/1915 | Haydon | 416/144 X |
| 2,366,795 | 1/1945 | Lamoreaux | 416/144 X |
| 3,007,743 | 11/1961 | Lange | 24/336 |
| 4,121,798 | 10/1978 | Schumacher et al. | 248/229 |
| 4,327,887 | 5/1982 | Kumakura | 248/229 |
| 4,693,673 | 9/1987 | Nee | 416/5 X |
| 4,750,863 | 6/1988 | Scoggins | 416/5 |
| 4,889,543 | 12/1989 | Burt | 416/146 R |
| 5,256,037 | 10/1993 | Chatelain | 417/423.7 |

FOREIGN PATENT DOCUMENTS

| | | | |
|---|---|---|---|
| 924741 | 5/1955 | Germany | 248/229 |

*Primary Examiner*—Edward K. Look
*Assistant Examiner*—Michael S. Lee
*Attorney, Agent, or Firm*—E. Michael Combs

[57] ABSTRACT

A ceiling fan mounts an elongate continuous tube member containing a viscous fluid permitting displacement of the fluid to counter-balance imbalance in a fan assembly, with the tube arranged for mounting to the individual fan blades of the fan assembly.

4 Claims, 5 Drawing Sheets

FIG. 9
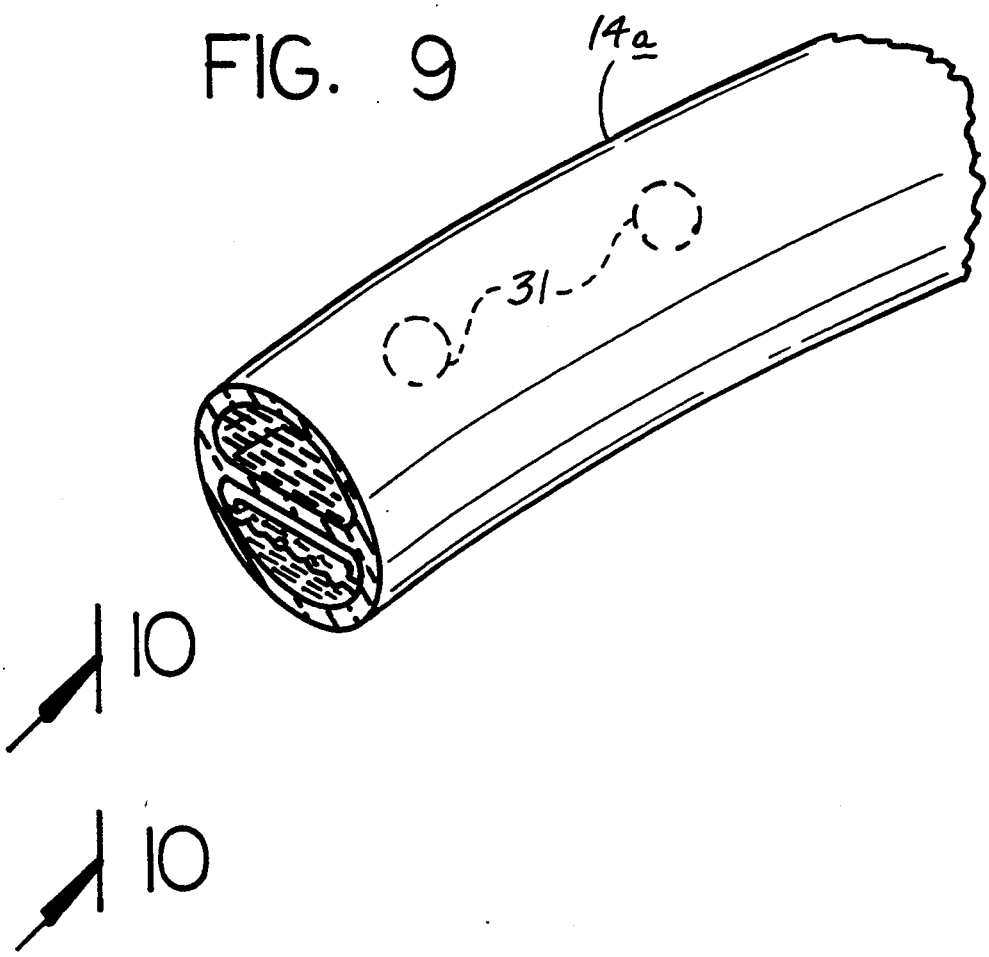
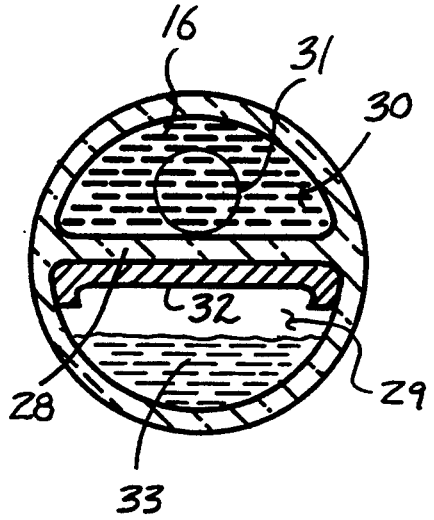
FIG. 10

CEILING FAN BALANCE APPARATUS

BACKGROUND OF THE INVENTION

1. Field of the Invention

The field of invention relates to a ceiling fan apparatus and more particularly to a Ceiling Fan Balance Apparatus to dynamically balance a ceiling fan during use.

2. Description of the Prior Art

Ceiling fan use of various types have been available in the prior art and exemplified by the U.S. Pat. Nos. 4,211,371; 4,568,247; 4,305,292; and 4,628,733.

The instant invention attempts to overcome deficiencies of the prior art by providing for a continuous dynamic balancing of the fan assembly during use and in this respect, the present invention substantially fulfills this need.

SUMMARY OF THE INVENTION

In view of the foregoing disadvantages inherent in the known types of fan balancing apparatus now present in the prior art, the present invention provides a ceiling fan balance apparatus wherein the same is arranged to mount a continuous tubular ring concentrically relative to a fan assembly, wherein the ring is arranged to include a viscous fluid for the dynamic balancing of the fan structure. As such, the general purpose of the present invention, which will be described subsequently in greater detail, is to provide a new and improved ceiling fan balance apparatus which has all the advantages of the prior art fan balancing apparatus and none of the disadvantages.

To attain this, the present invention provides a ceiling fan mounting an elongate continuous tube member containing a viscous fluid permitting displacement of the fluid to counter-balance imbalance in a fan assembly, with the tube arranged for mounting to the individual fan blades of the fan assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling fan balance apparatus which has all the advantages of the prior art fan balancing apparatus and none of the disadvantages.

It is another object of the present invention to provide a new and improved ceiling fan balance apparatus which may be easily and efficiently manufactured and marketed.

It is a further object of the present invention to provide a new and improved ceiling fan balance apparatus which is of a durable and reliable construction.

An even further object of the present invention is to provide a new and improved ceiling fan balance apparatus which is susceptible of a low cost of manufacture with regard to both materials and labor, and which accordingly is then susceptible of low prices of sale to the consuming public, thereby making such ceiling fan balance apparatus economically available to the buying public.

Still yet another object of the present invention is to provide a new and improved ceiling fan balance apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of a further modified tube structure.

FIG. 10 is an orthographic view, taken along the lines 10—10 of FIG. 9 in the direction indicated by the arrows.

DESCRIPTION OF THE PREFERRED EMBODIMENT

Figure 1:
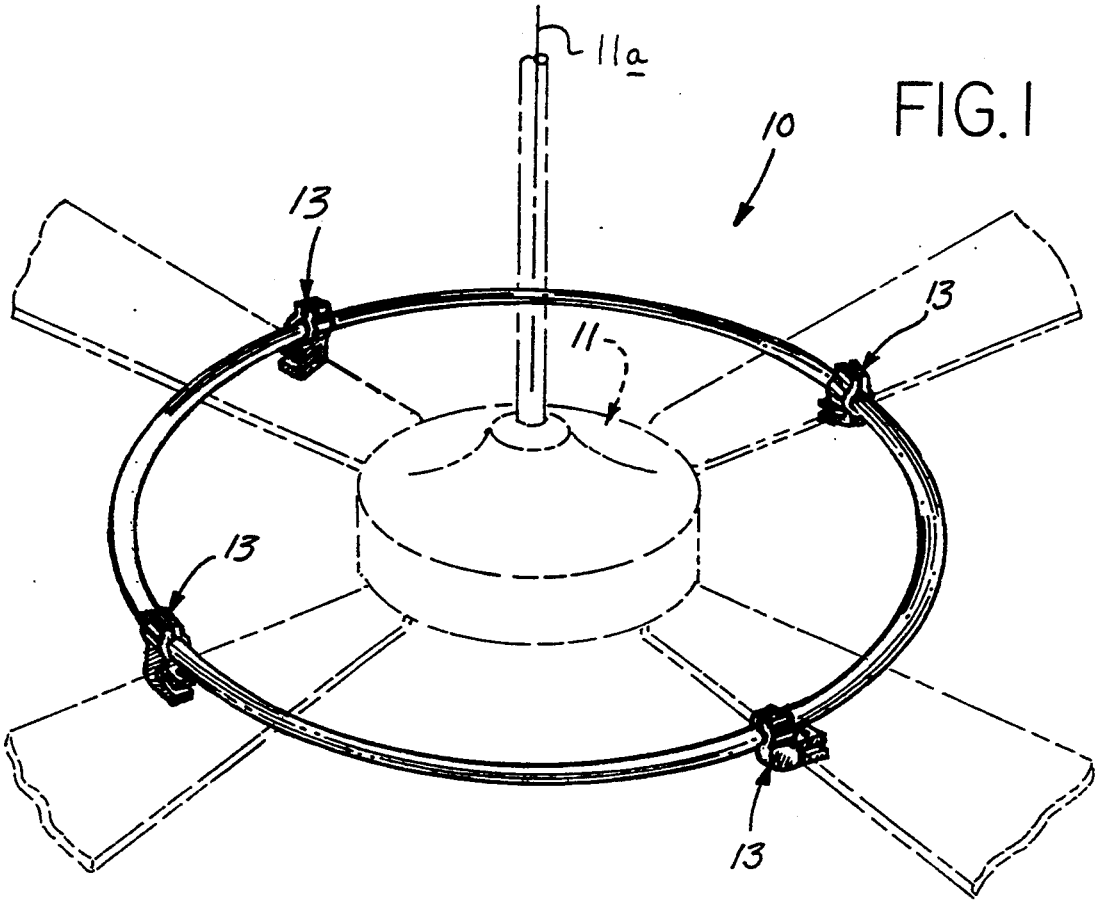
FIG. 1 is an isometric illustration of the invention.
Figure 2:
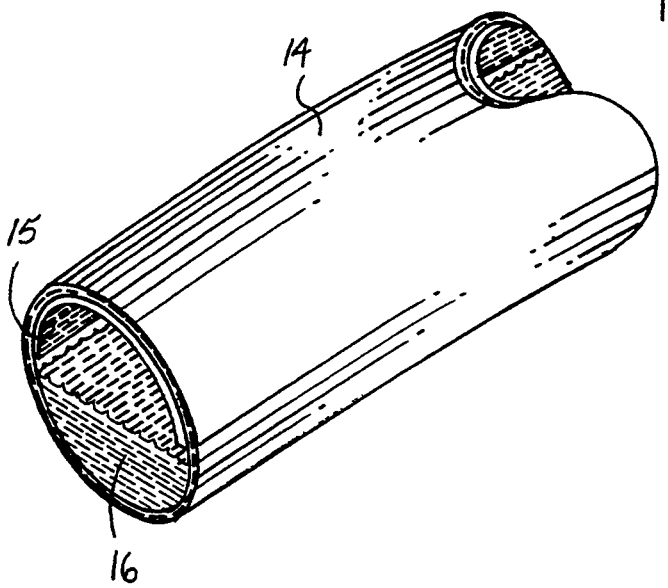
FIG. 2 is an enlarged isometric illustration in section illustrating the balance tube structure.
Figure 3:
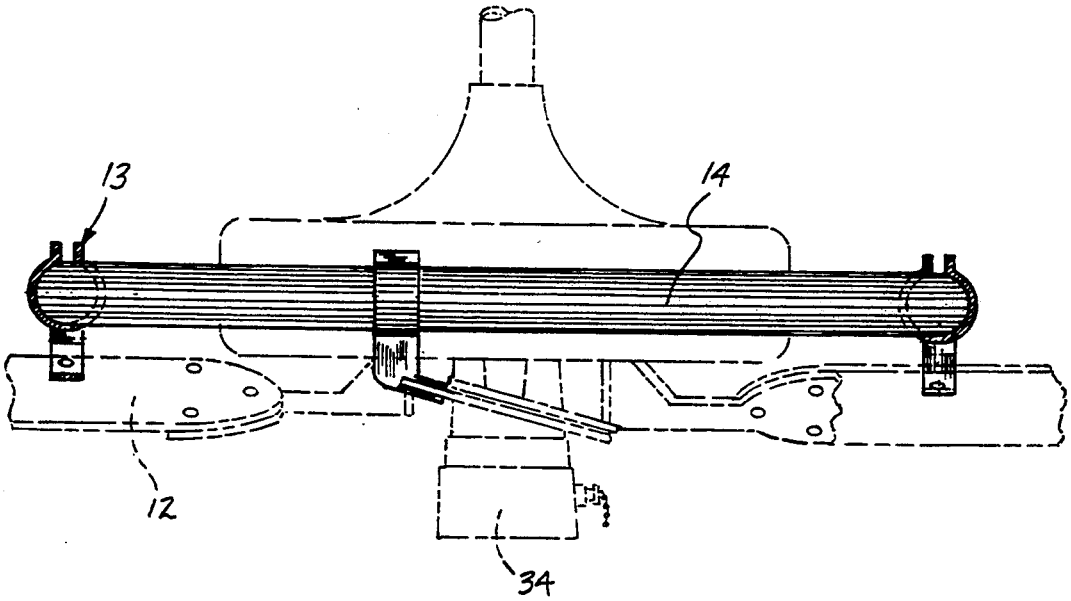
FIG. 3 is an orthographic side view of the invention.
Figure 4:
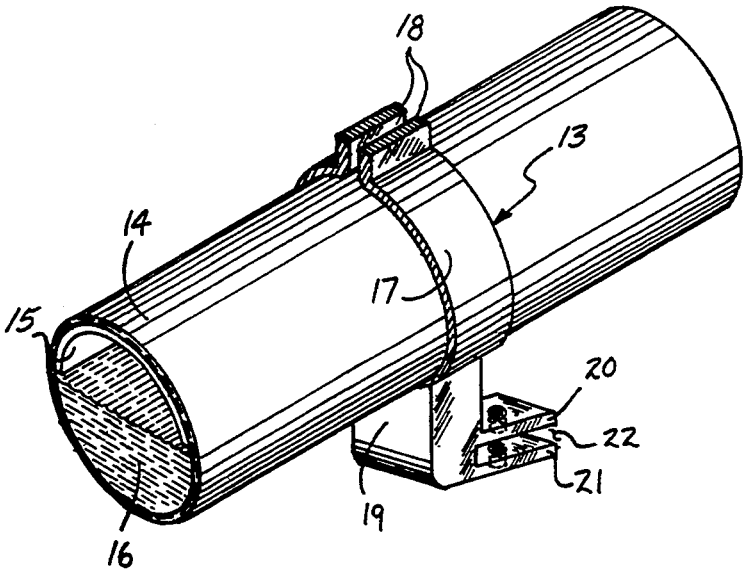
FIG. 4 is an enlarged isometric illustration of the tube structure mounting the clamp members thereto for securement to the ceiling fan blades.
Figure 5:
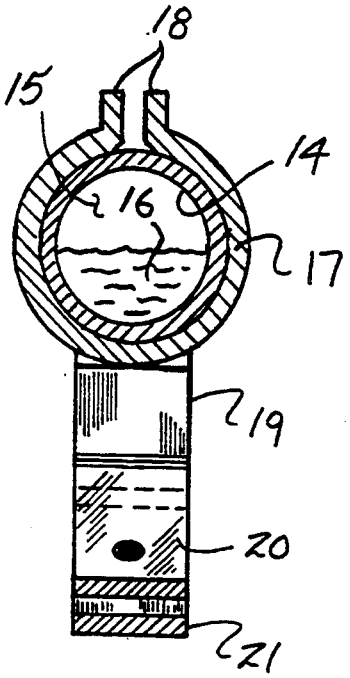
FIG. 5 is an orthographic cross-sectional illustration of the tube structure indicating the clamp member structure.
Figure 6:
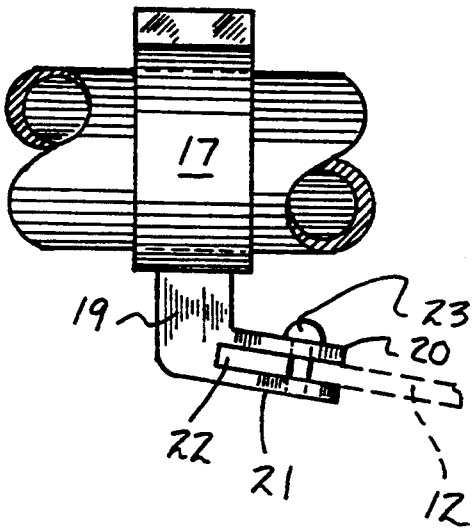
FIG. 6 is an orthographic side view of the clamp member structure.

With reference now to the drawings, and in particular to FIGS. 1 to 10 thereof, a new and improved ceiling fan balance apparatus embodying the principles and concepts of the present invention and generally designated by the reference numeral 10 will be described.

More specifically, the ceiling fan balance apparatus 10 of the instant invention essentially comprises mounting to a ceiling fan assembly 11 having a plurality of fan blades 12 rotatably mounted in an orthogonal relationship relative to a fan axis 11*a*. A plurality of clamp members 13 are provided, with an individual clamp member 13 mounted to an individual one of the fan blades 12. The clamp members 13 mount a continuous annular balance tube 14 to the clamp members 13, with the balance tube 14 arranged concentrically relative to the axis 11*a* positioned typically above the fan blades 12.

The balance tube 14 includes a continuous cavity 15 directed throughout the balance tube 14, having a first predetermined volume, wherein a viscous fluid 16 is contained within the cavity 15, having a predetermined second volume less than the first volume to permit ease of displacement and fluid flow of the viscous fluid 16. Further, this permits the viscous fluid to accumulate relative to portions of the tube to accommodate an imbalance in the fan structure.

Each of the clamp members 13 is formed with a discontinuous cylindrical band 17 arranged for clampingly securing about the balance tube 14, with the spring band 17 including facing flanges 18 permitting ease of grasping and displacing the spring band to permit reception of the balance tube 14 within the band, as well as movement of the band along the tube to permit ease of positioning relative to individual fan blades 12. A mounting boss 19 is fixedly mounted to the band 17 diametrically opposed relative to the flanges 18, with the mounting boss 19 including respective first and second plates 20 and 21 spaced parallel relative to one another defining a gap therebetween. The gap 22 is arranged to receive an individual fan blade member therebetween, with a fastener 23 directed through the first and second plates 20 and 21, as well as through the fan blade 12 within the gap 22, as illustrated for example in the FIG. 6.

Figure 7:
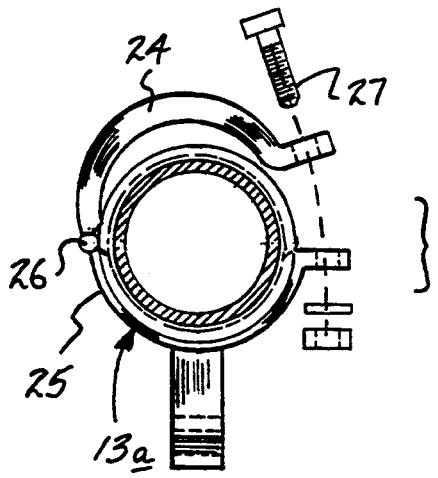
FIG. 7 is an orthographic view of a modified clamp member.
Figure 8:
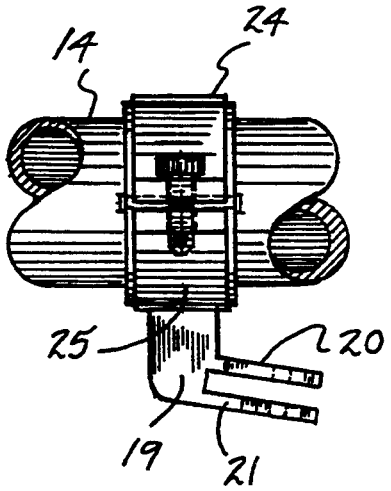
FIG. 8 is an orthographic side view of the modified clamp member.

The FIGS. 7 and 8 indicate a modified clamp structure, having first and second semi-cylindrical clamp members 24 and 25 pivotally mounted relative to one another about a hinge 26 utilizing clamp fastener 27 to secure the first and second clamp members 24 and 25 together.

The FIGS. 9 and 10 indicate the use of a modified balance tube structure 14*a*, having directed coextensively throughout the balance tube 14*a* a tube partition wall 28 that is oriented orthogonally relative to the axis 11*a* defining a first cavity 29 directed below the partition wall, with the second cavity 30 positioned above the partition wall, with the second cavity 30 having a viscous fluid directed coextensively therethrough, and including spherical counter-weight members 31 rotatably directed throughout the second cavity 30 to provide for the dampened movement of the spherical counter-weight members 31 to accommodate imbalance within the fan assembly 11.

The first cavity 29 includes a reflective mirror plate 32 oriented coextensively with the wall 28 and mounted to the wall 28 such that a chemiluminescent fluid 33 positioned within the first cavity is reflected from the mirror plate 32, as well as the mirror plate reflecting illumination from an illumination member 34 (see FIG. 3) spaced from the mirror plate 32 to direct illumination thereon to enhance illumination of the tube structure for enhanced enjoyment, as well as enhanced illumination directed from the tube structure relative to the fan assembly 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ceiling fan balance apparatus, comprising:

a fan assembly, having a plurality of fan blades, said fan assembly being adapted to rotate said fan blades about a fan assembly rotation axis, and a plurality of clamp members, wherein an individual clamp member is arranged for removable securement to a corresponding individual one of said fan blades, and a continuous annular balance tube removably mounted to the clamp members, said clamping members being adapted to orient said balance tube concentrically and orthogonally relative to said rotation axis, the balance tube having a continuous cavity directed through the balance tube, and the continuous cavity having a predetermined first volume, and a viscous fluid contained within the continuous cavity, with the viscous fluid having a second volume less than the first volume, wherein each said fan blade is disposed at an angle to a first plane perpendicular to said rotation axis and each said clamp member includes a first portion for engaging said annular balance tube and a second portion oriented at an angle to said first portion for engaging one edge of said corresponding fan blade disposed at an angle such that said first portion is disposed in a second plane perpendicular to said first plane when engaging said balance tube and the angle made by said second portion relative to said first portion is complementary to both said first and second planes.

2. An apparatus as set forth in claim 1 wherein each of said clamp members includes a discontinuous cylindrical spring band, the spring band having facing flanges arranged for ease of manual grasping and displacement for permitting selective positioning of each of said clamp members along the balance tube, and a mounting boss fixedly mounted to the spring band diametrically opposed relative to the flanges, the mounting boss including a first plate spaced from a second plate defining a gap therebetween, wherein the gap receives one of said fan blades therewithin, and a fastener directed through the first plate and the second plate for securement of said one of said fan blades within the gap.

3. A ceiling fan balance apparatus, comprising:

a fan assembly, having a plurality of fan blades, said fan assembly being adapted to rotate said fan blades about a fan assembly rotation axis, and a plurality of clamp members, wherein an individual clamp member is arranged for removable securement to a corresponding individual one of said fan blades, and a continuous annular balance tube removably mounted to the clamp members, said clamping members being adapted to orient said balance tube concentrically and orthogonally relative to said rotation axis, the balance tube having a continuous cavity directed through the balance tube, and the continuous cavity having a predetermined first volume, and a viscous fluid contained within the continuous cavity, with the viscous fluid having a second volume less than the first volume, wherein the balance tube includes a partition wall directed coextensively throughout the balance tube diametrically directed through the balance tube, with a continuous cavity oriented above the partition wall and a further cavity oriented below the partition wall, with the partition wall oriented orthogonally relative to the axis, and a plurality of spherical counter-weight members contained within the cavity oriented above the partition wall.

4. An apparatus as set forth in claim 3 wherein the partition wall includes a reflective mirror plate fixedly mounted to the partition wall coextensively with the partition wall within the further cavity, and a chemiluscent fluid contained within the further cavity.

* * * * *